United States Patent [19]

Spedding

[11] 4,324,339

[45] Apr. 13, 1982

[54] SAFETY DEVICE FOR USE WITH A CONTAINER

[76] Inventor: Oliver T. Spedding, 21 Oak Tree Plots, Krugersdorp, Transvaal, South Africa

[21] Appl. No.: 177,733

[22] Filed: Aug. 13, 1980

[30] Foreign Application Priority Data

Aug. 14, 1979 [ZA] South Africa ..... 79/4263

[51] Int. Cl.[3] ..... B65D 55/02

[52] U.S. Cl. ..... 215/219

[58] Field of Search ..... 215/219, 220

[56] References Cited

U.S. PATENT DOCUMENTS 3,027,035 3/1962 Farago ..... 215/219

FOREIGN PATENT DOCUMENTS 570312 12/1975 Switzerland ..... 215/219

*Primary Examiner*—George T. Hall

*Attorney, Agent, or Firm*—Harold L. Stults; Pasquale A. Razzano

[57] ABSTRACT

A safety device for use with a container with a screw cap. The device which preferably is made from plastics material has an annular body portion with an inwardly tapered inner wall. The screw cap is insertable into the body portion which is so dimensioned that the orientation of the cap is substantially maintained. The cap is held captive inside the body portion by means of a deflectable flange at the mouth of the body portion which permits the cap to be placed on, or be removed from, its closure position on the container but the cap and the device are nonetheless rotatable relatively to each other. The device restricts direct manual access to the cap. The device is frictionally engageable with the cap by urging the device towards the container. The device and the cap may then be rotated together to screw the cap on or off the container.

3 Claims, 4 Drawing Figures

SAFETY DEVICE FOR USE WITH A CONTAINER

BACKGROUND OF THE INVENTION

This invention relates to a safety device for use with a container.

Medicines and pharmaceutical preparations which are dispensed by pharmacists are very often sold in bottles to which are fitted screw caps. The use of medicines is strictly controlled because of harmful side effects such as may be caused by overdosing. It is therefore most desirable to keep all medicines out of the reach of young children who are unable to understand the implications and the dangers of drugs. Unfortunately even with the greatest of care accidents do happen for children gain possession of tablet filled bottles with alarming regularity and with consequences which are often tragic.

SUMMARY OF THE INVENTION

It is an object of the present invention to provide a safety device for use with a container with a screw cap which makes the removal of the cap more difficult particularly for young children.

The invention provides a safety device for use with a container with a screw cap, the device being loosely engageable with the cap and being rotatable relatively to the cap and including at least a first formation which is frictionally engageable with the cap when forced towards the container so that the device and the cap can be rotated relatively to the container.

The device may include an annular body portion into which the cap is insertable, and the first formation may comprise one or more projections on the inner wall of the body portion which are engageable with the cap. Preferably the first formation is formed by inwardly tapering at least a section of the inner wall of the body portion. The inner wall may thus be frustroconical The annular body portion, may, near its mouth, have at least one deformable formation which impedes disengagement of the device and the cap. Preferably the formation comprises an inwardly directed continuous flange. The formation may be deformable by bending or deflecting it, or by compressing it.

In a preferred form of the invention the safety device comprises an annular body portion into which a container cap is insertable, with the interior of the cap being accessible from externally of the body portion, a continuous inwardly directed flange at the mouth of the body portion which hinders retraction of the cap from the body portion, and an inwardly tapered formation inside the body portion remote from the flange with which the cap is frictionally engageable.

The invention also provides in combination a container with a neck to which is fitted a screw cap, and a cover which is engaged with the cap and which is rotatable relatively to the cap, the cover preventing or hindering direct manual access of the cap, the cover and the cap being frictionally engageable when the cover and container are forced together so that the cap may be screwed along the neck by rotation of the cover relatively to the container.

BRIEF DESCRIPTION OF THE DRAWINGS

The invention is further described by way of example with reference to the accompanying drawings in which.

DESCRIPTION OF A PREFERRED EMBODIMENT

Figure 1:
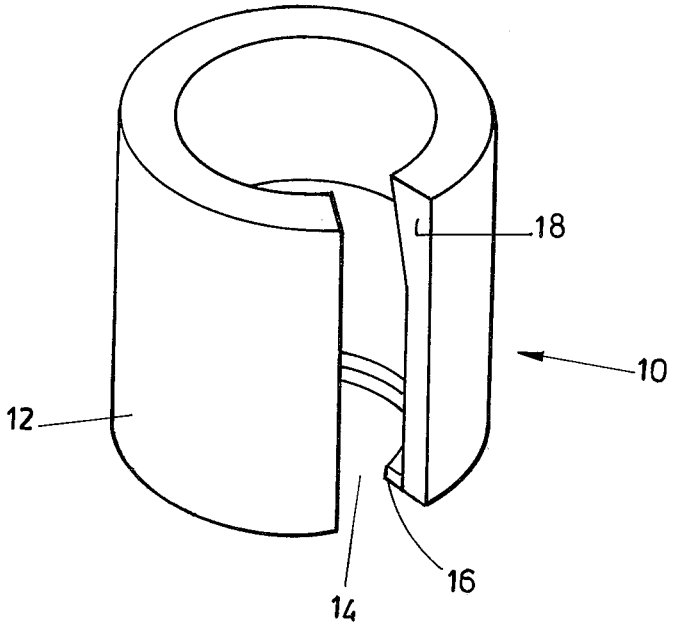
FIG. 1 is a perspective view, partly sectioned, of a safety device according to the invention.

The drawings illustrate a safety device 10 according to the invention which is moulded as an integral unit from a suitable plastics material. The device consists of an annular body portion 12 which has a mouth 14, a continuous inwardly directed flange 16 which is formed on the inner wall of the body portion 12 adjacent the mouth 14, and an inwardly tapered inner wall 18 at the end of the body portion 12 opposing the mouth 14.

The device 10 is intended for use with a container which has a neck 20 to which is fitted a screw cap 22. The cap, when screwed on to the neck 20, forms a lower shoulder 24.

The inner diameter of the flange 16 is slightly larger than the outer diameter of the neck 20. The flange however is slightly flexible.

Figure 2:
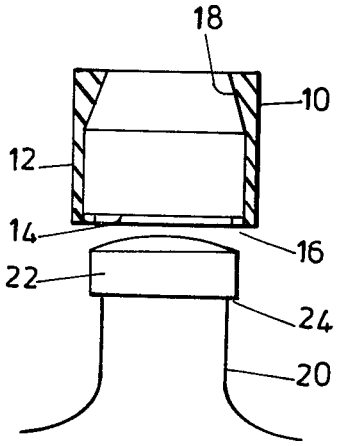
FIGS. 2 to 4 illustrate the manner in which the safety device of the invention is used with a container.
Figure 3:
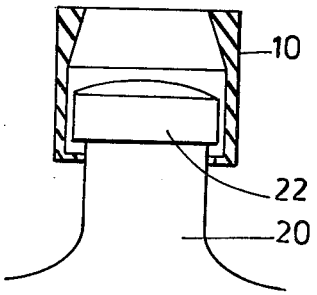
Figure 4:
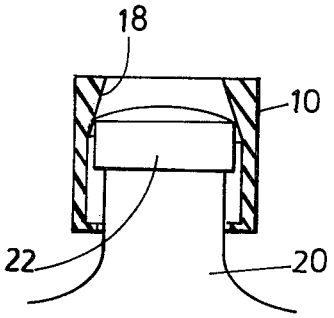

The device is used in the manner illustrated in FIGS. 2 to 4. When a bottle of drugs is dispensed the cap 22 is screwed in the normal manner on to the neck 20. The device 10 is then passed over the cap and the neck as shown in FIG. 3. To do this the device must be forced over the cap along the neck so that the flange is deformed by deflection, until the flange 16 passes the shoulder 24 of the cap. The flange then returns to its normal position, under its inherent resilience. This position is illustrated in FIG. 3.

At the FIG. 3 position the device is able to rotate relatively to the cap, without engaging with the cap, and at the same time the device covers the cap and prevents direct manual access of the cap. A child or any other person is therefore unable to grip the cap directly with the fingers and unscrew it from the container.

The cap may be removed from the container by forcing the device towards the container so that the tapered section of the wall 18 of the device is brought into frictional contact with the cap 22. The taper of the wall should be fairly pronounced so that a wedging action of the taper and the cap is avoided, but on the other hand the taper must permit the cap and the device to be frictionally interengaged. The plastics material from which the device is made should be fairly hard so that it is not significantly or permanently deformed by the cap. These features prevent the device and the cap from becoming inadvertantly locked to one another.

Once the device has been moved to the position shown in FIG. 4 it may be rotated and, provided the device and the container are continuously forced towards each other, the device is maintained in frictional contact with the cap and the cap may therefore be unscrewed from the neck 20. When the device and captive cap are removed from the container the cap is retained substantially in the correct orientation so that it may easily be replaced on the rim of the neck 20. To this end the internal dimensions of the device, in relation to the dimensions of the cap, are such that the cap cannot readily be inverted inside the device and consequently the mouth of the cap faces downwardly and is directly accessible through the mouth 14 of the device. The cap may be screwed on to the neck by frictional re-engagement of the device and the cap, in the manner described, and by rotation of the device in the appropriate direction.

I claim:

1. In combination, a container with a neck to which is fitted a screw cap which has an end wall and a side wall, said side wall being generally right cylindrical, and a safety device having a lower annular body portion into which said cap is insertable and within which is freely rotatable and a deformable portion near the mouth of said annular body portion which impedes withdrawal of said cap from said safety device, and said safety device also having an upper inwardly-tapered inner wall surface which is frictionally engageable with said cap at the junction of said end wall and said side wall when said safety device is forced axially towards said container, so that said cap and said safety device are prevented from being rotated relative to each other and can be rotated together relative to the container.

2. The construction described in claim 1 wherein said deformable portion is an inwardly projecting flange.

3. The construction as described in either of claims 1 or 2 wherein said safety device has a vertical mouth opening and wherein said deformable portion aids in providing the proper alignment on the screw cap.

* * * * *